United States Patent [19]

Susumu et al.

[11] Patent Number: 4,489,545

[45] Date of Patent: Dec. 25, 1984

[54] METHOD AND APPARATUS FOR PRODUCING A FASCIATED YARN

[75] Inventors: Kawabata Susumu, Aichi; Niimi Hiroshi, Nagoya; Anahara Meiji, Kariya; Omori Hiroshi, Aichi, all of Japan

[73] Assignees: Kabushiki Kaisha Toyoda Jidoshokki Seisakusho; Kabushiki Kaisha Toyota Chuo Kenkyusho, both of Aichi, Japan

[21] Appl. No.: 494,066

[22] Filed: May 12, 1983

[30] Foreign Application Priority Data

May 14, 1982 [JP] Japan ..... 57-080120

[51] Int. Cl.[3] ..... D02G 1/16

[52] U.S. Cl. ..... 57/333; 57/328

[58] Field of Search ..... 57/5, 328, 333, 350

[56] References Cited

U.S. PATENT DOCUMENTS 4,114,358 9/1978 Tsuchida et al. ..... 57/5 X 4,124,972 11/1978 Arai et al. ..... 57/350 X

FOREIGN PATENT DOCUMENTS 63439 5/1977 Japan ..... 57/333

*Primary Examiner*—Donald Watkins

*Attorney, Agent, or Firm*—Burgess, Ryan & Wayne

[57] ABSTRACT

A method and apparatus for producing a fasciated yarn, utilizing an air nozzle for false twisting a fiber bundle, provided with a fiber passage comprising an inlet portion, a small channel, and a large channel, characterized by the provision of at least a contact area in the inlet portion and/or the upstream region of the small channel. During the spinning operation, the fiber bundle is forced against the contact point, and, as a result, a twist imparted by a vortex can be effectively suppressed so that it does not ascend toward the upstream region.

Also, since the ballooning can be suppressed by the contact point, the size of the small channel can be increased, resulting in the sufficient suction air in the inlet portion.

11 Claims, 8 Drawing Figures

METHOD AND APPARATUS FOR PRODUCING A FASCIATED YARN

BACKGROUND OF THE INVENTION

1. Field of the Invention

The present invention relates to a method and an apparatus for producing a fasciated yarn.

2. Description of the Prior Art

In fasciated yarn spinning, a fiber bundle delivered from a pair of front rollers of a draft means is introduced into an air nozzle and therein is false twisted by a vortex. During untwisting of the false twisted fiber bundle, part of the fibers in the fiber bundle entangle around a core portion thereof to form a fasciated yarn. Generally speaking, in order to obtain a good quality yarn, the fiber bundle has to be fed in the shape of a ribbon having a sufficient number of free-end fibers prior to being twisted. A free-end fiber is a fiber wherein one end thereof is embedded in the body of the bundle and the other end is free. By the application of a vortex, part of the free-end fibers are converted to wrap fibers which entangle around the resultant yarn.

In order to generate a sufficient number of free-end fibers, twisting of the fiber bundle in the nozzle inlet must be suppressed as much as possible to maintain the ribbon shape thereof. Therefore, a typical conventional air nozzle has a small channel in its fiber passage between the inlet portion and a large channel in which a vortex is generated. The false twist of the fiber bundle can be prevented to a certain extent from ascending to the inlet portion by the small channel.

Naturally, the twist-suppressing effect increases as the cross-sectional size of the small channel becomes smaller. However, a reduction of the size of the small channel causes insufficient suction of the air nozzle, which results in various problems, such as the generation of many flies, fiber wrapping on the roller surface, and the generation of less free-end fibers.

On the contrary, simply increasing the size of the small channel results in a decrease of the twist-suppressing effect. This drawback is augmented by the generation of ballooning, which disrupts the stable spinning operation and deteriorates the quality of the resultant yarn.

When ballooning occurs in the air nozzle, the false twist imparted to the fiber bundle easily escapes upstream toward the front rollers, and, as a result, a final twist remaining in the downstream region of the fiber bundle is insufficient for forming a strong yarn.

In an attempt to eliminate such drawbacks, there is disclosed in Japanese unexamined patent publication (Kokai) No. 52-63439 an air nozzle having a bent large channel. In this air nozzle, the fiber bundle tends to deviate from the center axis of the large channel and the rotation thereof is braked by contact with the inner wall of the large channel. As a result, the total twist imparted to the fiber bundle is insufficient, and the resultant yarn has a looser structure than does a conventional yarn.

SUMMARY OF THE INVENTION

It is an object of the present invention to provide an apparatus for producing a fasciated yarn, the air nozzle of which has a good fiber sucking ability as well as a twist-blocking ability and a ballooning-suppressing ability.

It is another object of the present invention to provide a method for obtaining a fasciated yarn of good quality by blocking the twist ascent and by restraining ballooning in the air nozzle.

These objects are attainable by an apparatus for producing a fasciated yarn having an air nozzle for imparting a false twist to a fiber bundle to be treated, the nozzle comprising a fiber passage in which an inlet portion, a smaller channel, and a large channel are successively arranged from the upstream thereof to the downstream thereof along a traveling route of the fiber bundle, the large channel being provided with at least one jet pointing tangentially toward the fiber passage, the apparatus being characterized in that the small channel and the large channel are coaxially arranged and at least a contact area is formed in a zone from the inlet portion to an upstream region of said small channel;

an apparatus for producing a fasciated yarn comprising an air nozzle for imparting a false twist to a fiber bundle to be treated, the nozzle comprising a fiber passage in which an inlet portions, a small channel and a large channel are successively, coaxially and linearly arranged from the upstream thereof to the downstream thereof along a traveling route of the fiber bundle, said large channel being provided with at least one jet pointing tangentially toward the fiber passages, said apparatus being characterized in that said traveling route of the fiber bundle in the inlet portion is deviated from the center axis of said inlet portions, thereby at least a contact area is formed in an upstream region of the small channel; and a method for producing a fasciated yarn in which a fiber bundle delivered in a ribbon shape from a draft means is introduced into a fiber passage of an air nozzle, the passage comprising an inlet portion, a small channel, and a large channel, and therein is false twisted by a vortex to form the fasciated yarn, the method being characterized in that the fiber bundle is forcibly pressed against at least one contact area provided in a zone from the inlet portion to an upstream region of the small channel, whereby the traveling route of the fiber bundle is bent at the contact area at an angle $\theta$.

The present invention is embodied in the various features described below.

A first feature is characterized by an air nozzle with a bent fiber passage in which the inlet portion is bent relative to the small channel. A fiber bundle delivered from a pair of front rollers of a draft means touches the upstream edge of the small channel and the traveling direction thereof is changed. The upstream edge of the small channel constitutes a contact area which functions as a barrier or a brake for ballooning and twist ascent.

A second feature is characterized by an air nozzle with a straight fiber passage in which the inlet portion, the small channel, and the large channel are arranged coaxially in series. This type of nozzle is preferably utilized in conjunction with a deflection roller. The fiber bundle is introduced into the inlet portion along a path deviated from the center axis thereof so that the fiber bundle touches the upstream edge of the small channel. In this feature, the upstream edge of the small channel constitutes a contact area.

A third feature is characterized by an air nozzle with a bent inlet portion whereby two contact area are provided in the fiber passage. According to this feature, the above-mentioned twist-suppressing effect is more effectively achieved.

A fourth feature is characterized by an air nozzle having an inlet portion provided with at least one projection in the inner wall. The tip of the projection constitutes the contact area.

BRIEF DESCRIPTION OF THE DRAWINGS

The present invention is described more specifically with reference to the attached drawings, in which.

DESCRIPTION OF THE PREFERRED EMBODIMENTS

A first embodiment which is an actualization of the first feature of the present invention is described below with reference to FIGS. 1 through 3.

Figure 1:
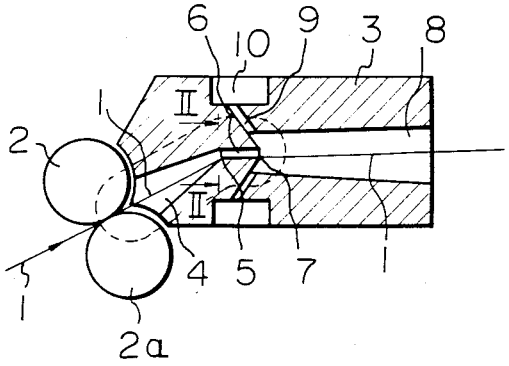
FIG. 1 is a sectional side view of a first embodiment according to the present invention.

In FIG. 1, downstream of a draft means comprising several pairs of rollers and/or aprons utilized for attenuating the fiber bundle 1, there is provided an air nozzle 3 confronting a pair of front rollers 2, 2*a*. The air nozzle 3 comprises a fiber passage which consists of an inlet portion 4, a small channel 6, and a large channel 8, all of which are arranged along the traveling route of the fiber bundle. A plurality of jets 9 is provided in the middle of the air nozzle 3. One end of each of the jets 9 communicates with a reservoir 10 recessed in the outer wall of the air nozzle 3. The other end of each of the jets 9 opens on the inner wall of the large channel 8 in the vicinity of the upstream end thereof. The jets 9 incline downstream so as to enhance the traveling of the fiber bundle and deviate tangentially relative to the axis of the fiber passage so as to generate a vortex. The reservoir 10, in turn, is connected to a pressurized air source (not shown).

In the first embodiment shown in FIG. 1, the fiber passage is bent at the border 5 between the inlet portion 4 and the small channel 6 in such a manner that the axis of the inlet portion 4 is directed towards the nip point of the rollers 2, 2*a* and intersects the axis of the small channel 6 at a point in the vicinity of the border 5. Any directional bending of the fiber passage can be adopted in this embodiment. However, bending in a plane perpendicular to the axes of the rollers 2, 2*a*, as is shown in FIG. 1 is most preferable.

Further, a cross section of the inlet portion 4 is preferably of a flattened shape with a long side 4*a* parallel to the border 5. The border 5 constitutes a contact area in the fiber passage (hereinafter the contact area is also indicated by reference numeral 5). The contact area 5 is preferably in the form of a sharp edge suitable for blocking the twist acent as long as the fibers to be treated are not damaged by the area 5. Further, the long side 4*a* is preferably a straight line, as is shown in FIG. 2. In such a case, the fiber bundle can be maintained in the ribbon shape imparted to it by the front rollers 2, 2*a* while at the same time being able to move freely in the traverse direction.

Under such conditions, a sufficient number of free-end fibers can be generated in the fiber bundle. In order to form the border 5 having a linear edge, the cross section of the inlet portion 4 is more preferably a cone with a base flattened in a direction parallel to the rollers 2, 2*a* rather than a circular base cone. Further, the cross section of the inlet portion 4 preferably gradually decreases in the traveling direction of the fiber bundle 1.

The fiber bundle 1 attenuated by the draft means is delivered from the nip point of the front rollers 2, 2*a* as a fiber ribbon to the inlet portion 4 of the air nozzle 3. The fiber bundle 1 travels along the axis of the inlet portion 4 and reaches the upstream end of the small channel 6. The fiber bundle 1 is forcibly brought into contact with the inner wall of the inlet portion 4 at the contact area 5 and thereafter travels to a downstream end 7 of the small channel 6 while being pressed against the inner wall thereof.

Air is introduced into the jets 9 opening in the upstream region within the large channel 8. The air forms a spiral vortex around the axis of the large channel 8 and twists the fiber bundle 1 delivered from the small channel 6. The vortex created in the large channel 8 is gradually exhausted and looses its spinning torque, resulting in untwisting of the fiber bundle 1 which was twisted in the upstream of the large channel. During untwisting operation, the free-end fibers are entangle around the core portion of the fiber bundle at a spiral angle of the same direction as the vortex, and thereby a fasciated yarn is obtained.

As was stated before, the twist of the fiber bundle in the inlet portion 4 is preferably as low as possible while that in the small channel 6 is preferably as high as possible for obtaining a good fasciated yarn since the twist difference between the upstream and downstream regions in the treated fiber bundle determines the number and spiral angle of the wrap fibers and, in turn, the structure of the fasciated yarn. The above-mentioned desirable twist distribution in the fiber bundle 1 mainly depends on the construction of the contact area 5. Especially, the bent angle of the fiber passage at the border between the small channel 6 and the inlet portion 4 greatly influences the ascending of the twist toward the upstream direction.

Figure 1A:
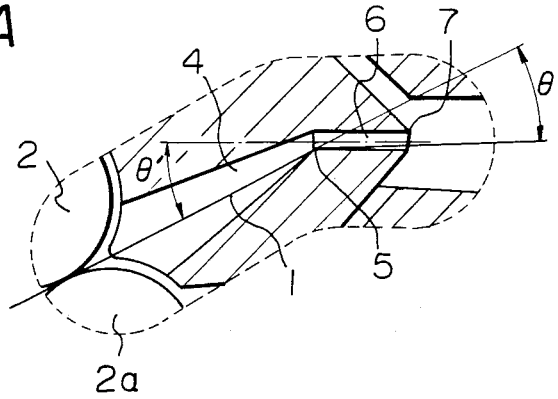
FIG. 1A is an enlarged view of the region within the broken line in FIG. 1.
Figure 2:
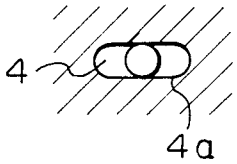
FIG. 2 is a frontal sectional view of the inlet portion of the first embodiment according to the present invention along II—II line in FIG. 1.
Figure 3:
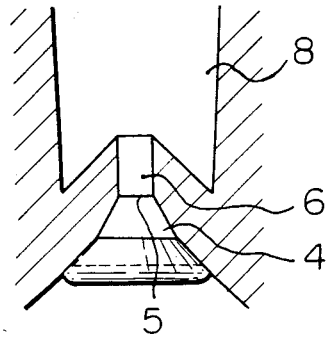
FIG. 3 is a sectional plan view of a part of the first embodiment.

According to the first embodiment shown in FIGS. 1 to 3, the twist which overflows from the contact area 5 directly reaches the nip point of the rollers 2, 2*a* since there is no barrier between the contact area and the nip point against the twist ascent. Therefore, the function of the contact point is very important in an air nozzle of this type. In a study made by the present inventors, it was found that the fiber passage is constructed in such a manner that a line extending from the nip point of the front rollers 2, 2*a* to the contact area, i.e., the traveling route of the fiber bundle 1 in the inlet portion 4, intersects the traveling route in the small channel 6 at an angle $\theta$ within a range of from 10 degrees to 60 degrees. Strictly speaking, the above-mentioned bent angle $\theta$ of the traveling route is somewhat different from the bent angle $\theta'$ of the small channel 6 relative to the inlet portion 4, as is shown in FIG. 1A. However, in the first embodiment in which the angle $\theta$ is relatively large, the angle $\theta$ can be replaced with the angle $\theta'$ without deteriorating the effect of the contact area.

According to the present invention, the cross-sectional size of the small channel can be increased relative to a conventional one since the traveling route of the fiber bundle can be fixed throughout the fiber passage, especially along the center axis of the large channel 8, under which condition yarn ballooning is properly controlled. This small channel 6 having an increased cross-sectional size enhances the amount of air sucked thereinto from the open end of the inlet portion 4, thereby decreasing the amount of flies in the vicinity of the front rollers 2, 2*a*.

Figure 4:
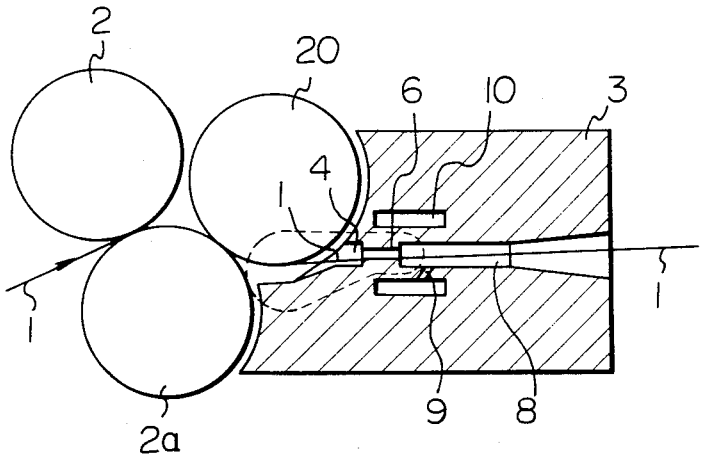
FIG. 4 is a sectional side view of a second embodiment according to the present invention.
Figure 4A:
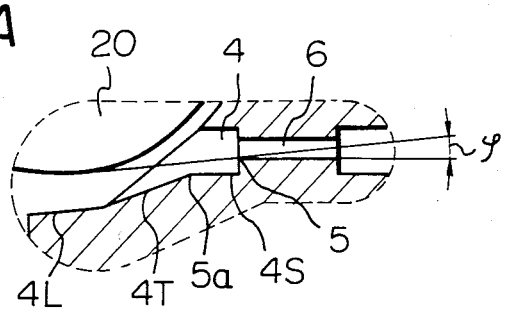
FIG. 4A is an enlarged view of the region within the broken line in FIG. 4.

A second embodiment which is an actualization of the second and the fourth features of the present invention is described with reference to FIG. 4.

In this embodiment, a deflection roller 20 which functions as a barrier against the twist ascent is provided between the front rollers 2, 2*a* and the air nozzle 3. The deflection roller 20 is disposed above the front bottom roller 2*a* with a slight clearance therebetween and is driven substantially at the same circumferential speed as that of the latter.

The fiber bundle 1 delivered from the front rollers 2, 2*a* is carried to the air nozzle 3 while contacting first the front bottom roller 2*a* and then the deflection roller 20.

In the air nozzle 3, an inlet portion 4, a small channel 6, and a large channel 8 are coaxially arranged along a straight line to form a fiber passage. The fiber bundle 1 traveling away from the deflection roller 20 travels through the inlet portion 4 to the small channel 6. Since the deflection roller 20 is disposed in such a manner that the bottom circumference thereof intersects the axis of the yarn passage, the traveling route of the fiber bundle in the inlet portion 4 deviates a maximum of 1 or 2 mm downward from the axis thereof and contacts the lower edge of the upstream end of the small channel 6. Therefore, the edge of the small channel 6 constitutes a contact area 5.

The traveling route is bent at the contact area 5 at a certain angle $\phi$ less than the abovesaid angle $\theta$ of the first embodiment.

Unlike in the first embodiment, it is not necessary that the twist ascent be completely suppressed at the contact area 5 since the twist ascent can be checked by the circumference of the deflection roller 20 as well as by the contact area 5 prior to reaching the nip point of the front rollers 2, 2*a*. Therefore, the intersecting angle $\phi$ may be lower than the angle $\theta$ of the first embodiment. Especially, if the suction force of the air nozzle is strong and the draw ratio of the rollers 2, 2*a* to a pair of take-up rollers (not shown) is relatively small, the fiber bundle 1 has a high tension while passing through the yarn passage and is strongly pressed against the inner wall thereof. Therefore, a smaller bent angle $\phi$ of, e.g., 2 degrees may be sufficient against the twist ascent. On the contrary, an excessively large angle $\phi$ e.g., a right angle is not preferable since fluffs or yarn breakage may occur due to the rubbing of the fiber bundle against the contact area. Accordingly, part of the inner wall of the fiber passage, with which the fiber bundle is in contact, is preferably made of nonabrasive material such as ceramic or the like.

The inlet portion 4 consists of a straight section 4S having a somewhat longer height than that of the small channel 6, a tapered section 4T having a width diverging in the upstream direction and section 4L extending to the vicinity of the bottom roller 2*a*.

The border between the straight section 4S and the tapered section 4T constitutes a convex edge 5*a*, with which the fiber bundle 1 can be in contact if ballooning occurs in the inlet portion 4, thereby suppressing ballooning. This convex edge 5*a* has the same function as the contact area 5 and can check the twist ascent in the abovesaid case.

According to the second embodiment, the twist imparted to the fiber bundle by the vortex can be blocked, and thus prevented from ascending in the upstream direction, by the contact area 5 constituted of the lower edge of the upstream end of the small channel 6. Further, the bollooning and the twist ascent which accompanied therewith can be suppressed by the convex edge 5*a* in the inlet portion 4. Thus, the second embodiment is advantageous in that the stablility of the spinning operation is enhanced and in that a good quality fasciated yarn excellent in evenness and mechanical strength can be produced. Compared to the first embodiment, the second embodiment is superior in respect to the the generation of free-end fibers due to the provision of the deflection roller 20, which prevents the fiber bundle delivered from the nip point of the front rollers 2, 2*a* from twisting when ascending prior to being introduced into the inlet portion 4, by contact with the surfaces of the bottom roller 2 and the deflection roller 20.

A modification of the second embodiment results in the same effect as that of the first embodiment, in which the fiber passage is bent at the border between the inlet portion 4 and the small channel 6 at an angle of approximately 2 or 3 degrees and the fiber bundle travels along the axis of the inlet portion 4.

In the first and second embodiments, the bent angle $\theta$ or $\phi$ of the traveling route at the contact area 5 is suitably selected within a range of from 2 to 90 degrees, taking the effect of another twist-suppressing element, such as the deflection roller which is provided in the vicinity of the front rollers, into consideration.

Figure 5:
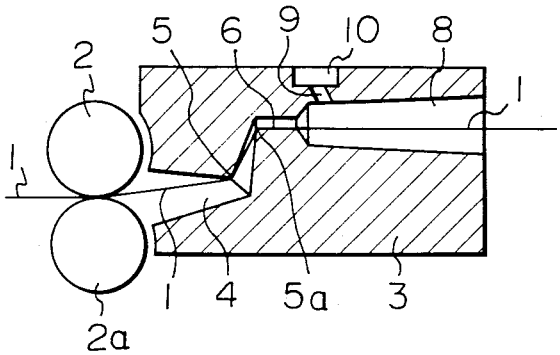
FIG. 5 is a sectional side view of a third embodiment according to the present invention.

A third embodiment which is an actualization of the third feature of the invention is illustrated in FIG. 5.

According to the third embodiment, two contact area 5, 5*a* are provided by bending the fiber passage twice in the inlet portion 4. The twist ascent can be effectively blocked by the two contact area 5, 5*a*, and a fasciated yarn of a superior mechanical strength can be obtained.

The air nozzle 3 shown in FIG. 5 can be manufactured by incorporating at least two segments thereinto.

The number of bendings of the fiber passage is preferably less than three since an excessive number of bendings increases the frictional resistance of the fiber passage to the fiber bundle, thereby causing a tension unbalance in the latter. That is, the fiber bundle slacks in the inlet portion, thereby causing ballooning, and, on the contrary, becomes tense in the large channel, with the result that the twist efficiency of the vortex is lowered.

Figure 6:
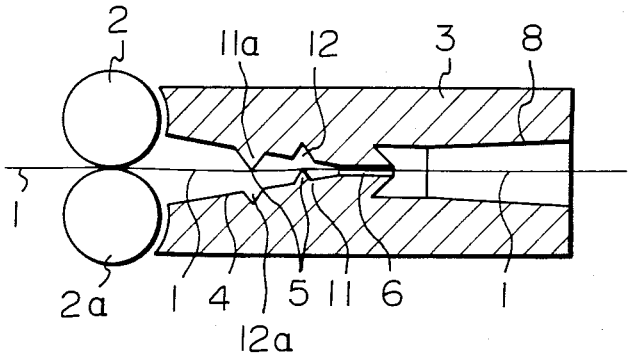
FIG. 6 is a sectional side view of a fourth embodiment according to the present invention.

A fourth embodiment which is an actualization of the fourth feature of the invention is illustrated in FIG. 6.

According to the fourth embodiment, the fiber passage has two projections 11, 11*a* in the inner wall thereof. A cross section of each of the projections 11, 11*a* is of an arc shape along the axis of the fiber passage. The traveling route of the fiber bundle is substantially bent by the projections in such a manner that the fiber bundle contacts the tops of the latter, that is, the projections constitute the contact area. It is preferable to provide recesses 12, 12*a* in the opposite wall of the fiber passage in such a manner that each recess confronts the projections 11 and 11*a* respectively, so as to secured a passage of the air sucked from the open end of the inlet portion 4. The axis of the fiber passage may be straight, as is shown in FIG. 6, or bent as was stated before.

According to the present invention, the generation of ballooning in the fiber passage can be suppressed by making the fiber bundle contact the contact area(s). Further, if ballooning occurs in the fiber passage, it can be easily suppressed before being transmitted to the vicinity of the front rollers by the action of the contact area(s). As a result, unstable spinning can be avoided. Due to the twist-suppressing effect of the contact area, a sufficient twist difference can be maintained between the upstream and downstream regions of the fiber bundle, thereby making it possible to obtain a tightly entangled fasciated yarn.

Moreover, due to the abovesaid twist-blocking effect, a plurality of free-end fibers is generated in the upstream region of the fiber bundle, thereby yielding a good fasciated yarn of uniform quality and without fluffs.

Further, according to the present invention, since the size of the small channel can be increased without considering the twist ascent, the suction of the air nozzle can be improved, thereby decreasing the amount of flies.

We claim:

1. An apparatus for producing a fasciated yarn having an air nozzle for imparting a false twist to a fiber bundle to be treated, said nozzle comprising a fiber passage in which an inlet portion, a smaller channel, and a large channel are successively arranged from upstream to downstream along a traveling route of said fiber bundle, said large channel being provided with at least one jet pointing tangentially toward said fiber passage, said apparatus being characterized in that said small channel and said large channel are coaxially arranged and at least a contact area is formed in a zone extending from said inlet portion to an upstream region of said small channel.

2. An apparatus according to claim 1, characterized in that said contact area is provided at a border between said inlet portion and said small channel by connecting said inlet portion to said small channel in a bent manner so that the center axis of said inlet portion and the center axis said small channel intersect each other.

3. An apparatus according to claim 2, characterized in that said inlet portion is bent at least once, thereby providing more than two contact areas.

4. An apparatus for producing a fasciated yarn having an air nozzle for imparting a false twist to a fiber bundle to be treated, said nozzle comprising a fiber passage in which an inlet portion, a smaller channel, and a large channel are successively arranged from upstream to downstream along a travelling route of said fiber bundle, said large channel being provided with a plurality of jets pointing tangentially toward said fiber passage, said small channel and said large channel being coaxially arranged and at least a contact area being formed in a zone extending from said inlet portion to an upstream region of said small channel, said inlet portion being provided with at least one projection in the inner wall thereof, the tip of said projection constituting said contact area.

5. An apparatus for producing a fasciated yarn comprising an air nozzle for imparting a false twist to a fiber bundle to be treated, said nozzle comprising a fiber passage in which an inlet portion, a small channel, and a large channel are successively, coaxially and linearly arranged from upstream to downstream along a traveling route of said fiber bundle, said large channel being provided with at least one jet pointing tangentially toward said fiber passage, said apparatus being characterized in that said traveling route of said fiber bundle in said inlet portion is deviated from the center axis of said inlet portions, whereby at least a contact area is formed in an upstream region of said small channel.

6. An apparatus according to claim 5, characterized in that said deviation of said traveling route of said fiber bundle in said inlet portion is caused by a deflection roller disposed in front of said inlet portion in such a manner that part of said deflection roller intersects the center axis of said inlet portion, thereby creating said contact area at the border between said inlet portion and said small channel.

7. A method for producing a fasciated yarn in which a fiber bundle delivered in a ribbon shape from a draft means is introduced into a fiber passage of an air nozzle, said passage comprising an inlet portion, a small channel, and a large channel, and therein is false twisted by a vortex to form said fasciated yarn, said method being characterized in that said fiber bundle is forcibly pressed against at least one contact area provided in a zone from said inlet portion to an upstream region of said small channel, whereby the traveling route of said fiber bundle is bent at said contact area at an angle $\theta$.

8. A method according to claim 7, characterized in that said angle $\theta$ is within a range of from 2 degrees to 90 degrees.

9. A method according to claim 7, characterized in that said fiber bundle contacts a surface of a deflection roller prior to being introduced into said fiber passage.

10. A method according to claim 8, characterized in that said fiber bundle contacts a surface of a deflection roller prior to being introduced into said fiber passage.

11. An apparatus according to claim 5, characterized in that said inlet portion is provided with at least one projection in the inner wall thereof, the tip of said projection constituting said contact area.

* * * * *